United States Patent [19]

Kaminaga

[11] Patent Number: 4,599,838

[45] Date of Patent: Jul. 15, 1986

[54] JOINT ASSEMBLY OF HORIZONTALLY OPPOSED CURTAIN WALL UNITS

[75] Inventor: Hiromitsu Kaminaga, Kurobe, Japan

[73] Assignee: Yoshida Kogyo K. K., Tokyo, Japan

[21] Appl. No.: 609,334

[22] Filed: May 11, 1984

[30] Foreign Application Priority Data

May 13, 1983 [JP] Japan ..... 58-70436[U]

[51] Int. Cl.[4] ..... E04B 2/88; E04H 1/00

[52] U.S. Cl. ..... 52/235; 52/403

[58] Field of Search ..... 52/235, 397–403, 52/730, 731; 49/DIG. 1, DIG. 2; 285/191

[56] References Cited

U.S. PATENT DOCUMENTS

| | | | |
|---|---|---|---|
| 3,052,330 | 9/1962 | Hammitt et al. | 52/403 X |
| 3,466,826 | 9/1969 | Gallagher et al. | 52/235 X |
| 3,553,918 | 1/1971 | Dauson | 52/235 X |
| 3,940,897 | 3/1976 | Stoakes | 52/397 X |
| 3,956,863 | 5/1976 | Tiedeken | 52/399 |
| 4,155,972 | 9/1978 | Varlonga | 52/403 X |
| 4,458,745 | 7/1984 | Gartner | 285/191 X |
| 4,525,963 | 7/1985 | Gartner | 52/235 |

FOREIGN PATENT DOCUMENTS

| | | | |
|---|---|---|---|
| 3108355 | 9/1982 | Fed. Rep. of Germany | 52/235 |
| 57-161434 | 10/1982 | Japan . | |

*Primary Examiner*—John E. Murtagh
*Assistant Examiner*—Richard E. Chilcot, Jr.
*Attorney, Agent, or Firm*—Hill, Van Santen, Steadman & Simpson

[57] ABSTRACT

In a joint assembly of two adjacent curtain wall units, an exterior gasket is divided into a pair of interfitting male and female halves carried by respective exterior parts of the adjacent vertical frame members. An interior gasket mounted between opposed interior parts of the adjacent vertical frame members has opposite edge portions each fitted in a recess of the respective interior part and projecting beyond the interfitting edges of the male and female gasket halves. In installation, one of the opposite edge portions of the interior gasket can be observed by the workman's eye through a gap between the male and female gasket halves while it is being inserted into the recess of the corresponding interior part.

2 Claims, 4 Drawing Figures

JOINT ASSEMBLY OF HORIZONTALLY OPPOSED CURTAIN WALL UNITS

BACKGROUND OF THE INVENTION

1. Field of the Invention

The present invention relates to a curtain wall construction composed of a plurality of curtain wall units arranged in rows and colums, and more particularly to a joint assembly of an adjacent pair of horizontally opposed curtain wall units.

2. Description of the Prior Art

A known joint assembly between an adjacent pair of horizontally opposed curtain wall units, as disclosed in Japanese Patent Laid-Open Publication (Kokai) No. 57-161434, comprises an interior gasket and an exterior sealing strip, both mounted between opposed vertical frame members of the two adjacent curtain wall units. The interior gasket has opposite edge portions respectively fitted in opposed interior recesses of the adjacent vertical frame members, while the exterior sealing strip is carried by one of the adjacent vertical frame members and extends into an exterior recess of the other vertical frame member.

With this prior arrangement, when one curtain wall unit is joined with the previously installed curtain wall unit, the interior gasket and the exterior sealing strip are received respectively in the interior and exterior recesses of the adjacent vertical frame members at the same time. That is, the exterior sealing strip would serve as a blind so that the workman cannot observe the interior gasket from the exterior while it is being fitted in the interior recesses, causing inaccurate and non-easy joining of the adjacent curtain wall units. Further, after the adjacent curtain wall units have been joined together, the sealing strip cannot be removed and, therefore, the workman cannot ascertain from the exterior whether the interior gasket is properly received in the opposed interior recesses of the vertical frame members.

SUMMARY OF THE INVENTION

In the present joint assembly of two adjacent curtain wall units, an exterior gasket is divided into a pair of interfitting male and female halves carried by respective exterior parts of the adjacent vertical frame members. An interior gasket mounted between opposed interior parts of the adjacent vertical frame members has opposite edge portions each fitted in a recess of the respective interior part and projecting beyond the interfitting edges of the male and female gasket halves. In installation, one of the opposite edge portions of the interior gasket can be observed by the workman's eye through a gap between the male and female gasket halves while it is being inserted into the recess of the corresponding interior part.

It is therefore an object of the present invention to provide a joint asseambly of two adjacent curtain wall units which enables the workman to observe from the exterior whether opposite edge portions of an interior gasket are properly fitted in opposed recesses of the opposed interior parts not only during the joining of the adjacent curtain wall units, but also after the latter have been joined.

Another object of the invention is to provide a joint assembly with which two adjacent curtain wall units can be joined with each other along their opposed vertical frame members easily with adequate fluid-tightness.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
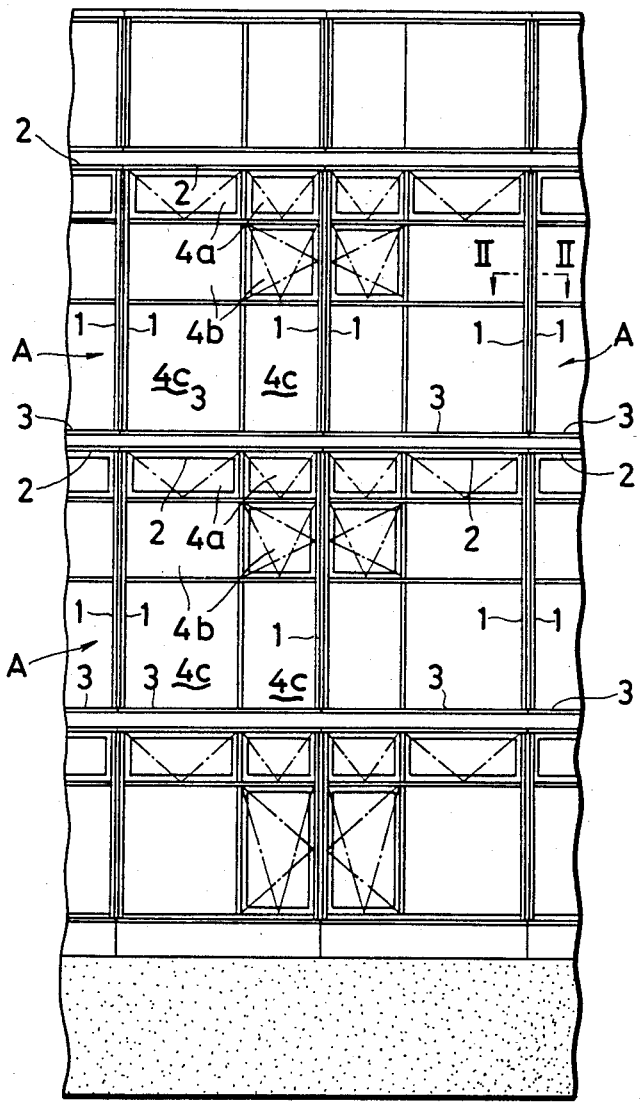
FIG. 1 is a fragmentary front elevational view of a curtain wall construction in which an adjacent pair of horizontally opposed curtain wall units is joined by a joint assembly embodying the present invention.

FIG. 1 illustrates a curtain wall construction composed of a plurality of curtain wall units A mounted on a building in a checkerboard pattern. Each of the curtain wall units A comprises a pair of vertical frame members 1, 1 and a pair of upper and lower horizontal frame members 2, 3 joined with the vertical frame members 1, 1 end to end to provide a rectangular frame. This rectangular frame is divided, by a mullion and two transoms, into six smaller rectangles of different sizes to support two lights *4a, 4a,* a fixed double-glazed panel *4b,* a pivotable double-glazed panel *4b,* and two insulating panels or glass panes *4c, 4c.*

Figure 2:
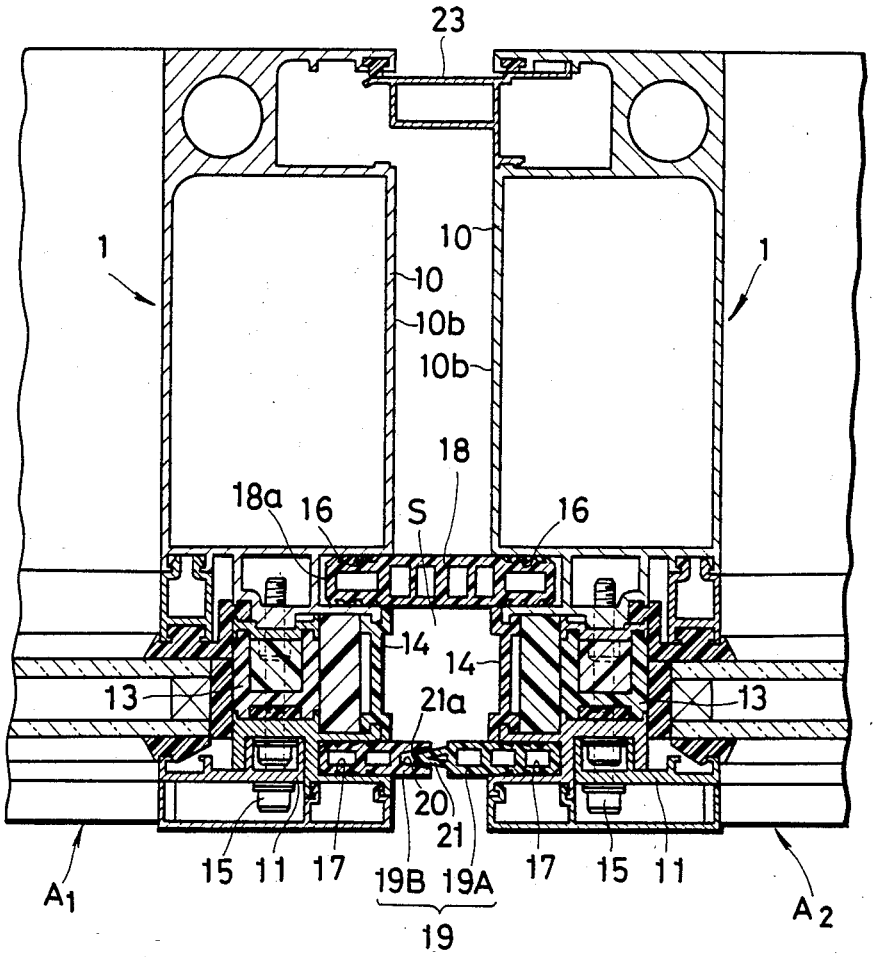
FIG. 2 is an enlarged horizontal cross-sectional view taken along line II—II of FIG. 1.

As shown in FIG. 2, an adjacent pair of horizontally opposed curtain wall units $A_1$, $A_2$ is joined with each other along their opposed vertical frame members 1, 1 in a manner described below. Each of the vertical frame members 1 includes a pair of interior and exterior parts 10, 11 interconnected by a screw 15, with a pair of first and second spacers 13, 14 of thermally insulating material sandwiched between the interior and exterior parts 10, 11. Each of the interior and exterior parts 10, 11 has along the entire length thereof a laterally opening vertical recess 16, 17.

A pair of parallel interior and exterior vertical gaskets 18, 19 is mounted between the adjacent vertical frame members 1, 1 so as to define therebetween a vertical space S. The interior vertical gasket 18 has opposite edge portions fitted respectively in the recesses 16, 16 of the interior parts 10, 10 of the adjacent vertical frame members 1, 1.

The exterior vertical gasket 19 is composed of a pair of interfitting male and female halves 19A, 19B. The male gasket half 19A has a base fitted in the recess 17 of one of the opposed exterior parts 11 and has along its free edge a longitudinal tongue 21. The female gasket half 19B has a base fitted in the recess 17 of the other of the opposed exterior parts 11 and has along its free edge a longitudinal groove 20 receiving the tongue 21 of the male gasket half 19A, the depth of the groove 20 being smaller than the depth of the recess 16 of each interior part 10. Thus the interior and exterior vertical gaskets 18, 19 jointly serve to provide a fluid-tight sealing between the adjacent pair of horizontally opposed curtain wall units $A_1$, $A_2$.

An auxiliary seal member 23 has a base carried by one of the adjacent interior parts 10, and a free edge contacting the other of the adjacent interior parts 10.

Figure 3:
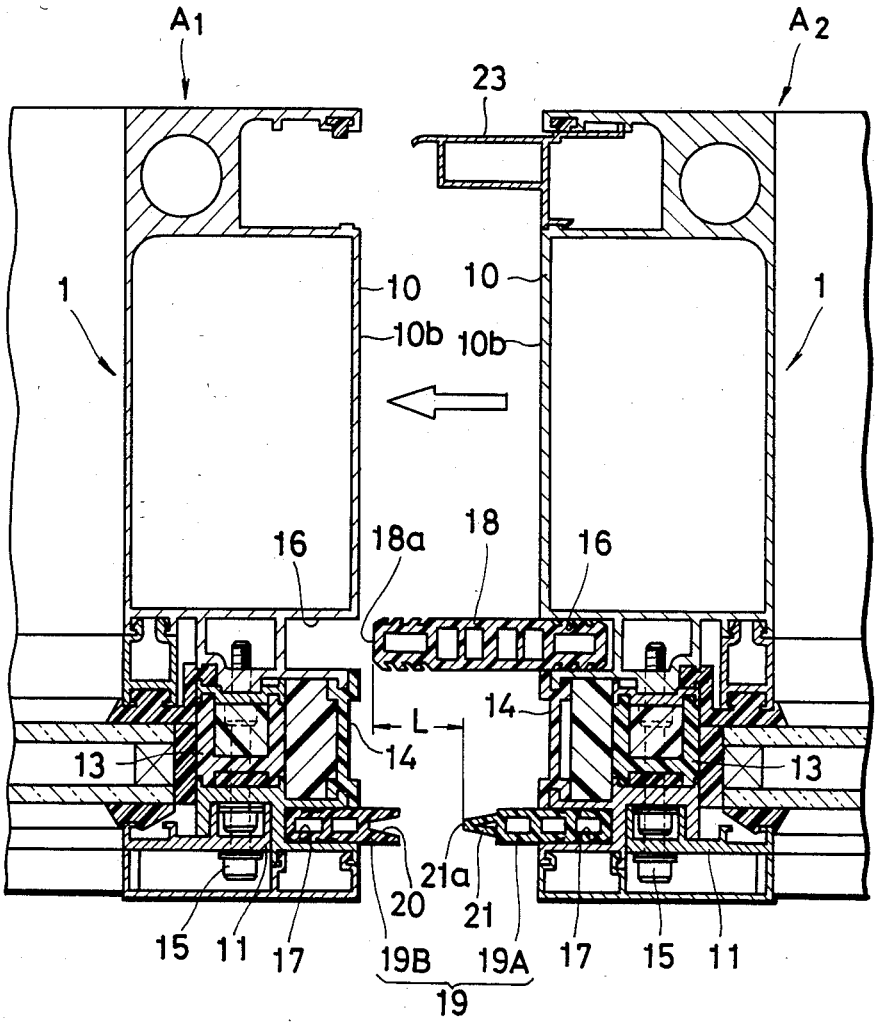
FIG. 3 is a horizontal cross-sectional view similar to FIG. 2, illustrating the manner in which an adjacent pair of horizontally opposed curtain wall units is joined.

For assembly, as shown in FIG. 3, the female half 19B of the exterior gasket 19 is fitted in the recess 17 of the exterior part 11 of the left curtain wall unit $A_1$ that has been previously installed. The male half 19A of the exterior gasket 19 is fitted in the recess 17 of the exterior part 11 of the right curtain wall unit $A_2$ that is to be joined with the left curtain wall unit $A_1$, and the right edge portion of the interior gasket 18 is inserted in the recess 16 of the interior part 10 of the right curtain wall unit $A_2$.

Figure 4:
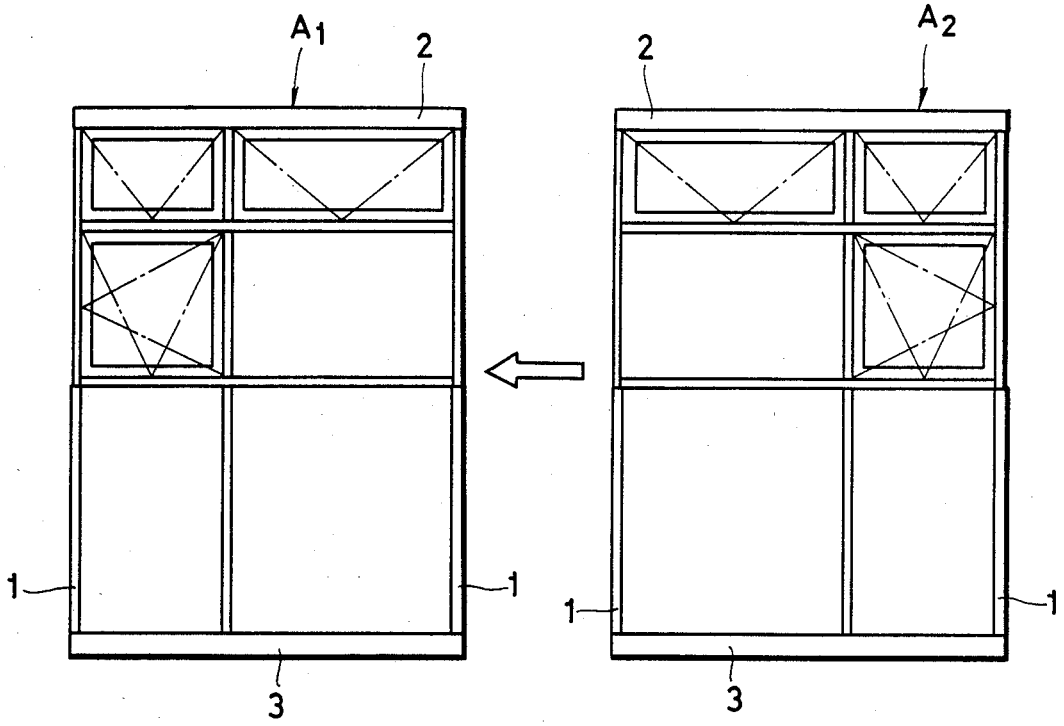
FIG. 4 is a front elevational view corresponding to FIG. 3.

Subsequently, the right curtain wall unit $A_2$ is positioned in horizontal alignment with the left curtain wall unit $A_1$, as shown in FIG. 4, and is then moved toward the left curtain wall unit $A_1$ to the position of FIG. 3 in which the left edge portion of the interior gasket 18 is disposed close to the recess 16 of the interior part 10 of the left curtain wall unit's vertical frame member 1. With continued leftward movement of the right curtain wall unit $A_2$, the left edge portion of the interior gasket 18 is inserted into the recess 16 of the interior part 10 of the left curtain wall unit's vertical frame member 1, and thereafter the tongue 21 of the male gasket half 19A is inserted into the groove 20 of the female gasket half 19B. Before the insertion of the tongue 21, the left edge portion of the interior gasket 18 can be observed by the workman's eye from the exterior through a gap between the male and female gasket halves 19A, 19B until it is inserted into the recess 16 of the interior part 10 of the left curtain wall unit's vertical frame member 1, because the left edge **18*a* of the interior gasket 18 projects beyond the distal edge 21*a* of the male gasket half's tongue 21 by a predetermined length L in an edgewise direction of the curtain wall units $A_1$, $A_2$. Preferably, the length L is smaller than half the length of the interior gasket 18 and larger than the length of each edge portion of the interior gasket 18**.

By this observing, it is possible to insert the left edge portion of the interior gasket 18 in the recess 16 of the interior part 10 of the left curtain wall unit's vertical frame member 1 without difficulty, thus causing accurate and easy joining of the right and left curtain wall units $A_2$, $A_1$.

Still, after the two adjacent curtain wall units $A_1$, $A_2$ have been joined, by removing the screws 15 to enable the removal of the male and female gasket halves 19A, 19B, or by pushing the same interiorly, to provide a gap in the exterior gasket 19, the workman can ascertain not only whether the opposite edge portions of the interior gasket 18 are properly fitted in the opposed recesses 16, 16 of the adjacent interior parts 10, 10, but also whether the first and second spacers 13, 14 are good or bad.

The interfitting tongue 21 and groove 20 of the male and female gasket halves 19A, 19B jointly serve as a throating along which rainwater would run down smoothly.

In an alternative way, the female gasket half 19B and the interior gasket 18 may be attached respectively to the exterior and interior parts 11, 10 of the previously installed left curtain wall unit $A_1$, with the male gasket half 19A attached to the exterior part 11 of the free right curtain wall unit $A_2$. Then the right curtain wall unit $A_2$ is moved toward the left curtain wall unit $A_1$ for joining therewith, at which time the right edge portion of the interior gasket 18 can be observed by the workman's eye from the exterior through a gap between the male and female gasket halves 19A, 19B until it is almost fully inserted in the recess 16 of the interior part 10 of the right curtain wall unit $A_2$.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A joint assembly of two adjacent curtain wall units having respectively a horizontally opposed pair of first and second vertical frame members, comprising:

(a) the first and second vertical frame members each having respectively a first and a second vertical recess, said first and second vertical recesses of the first vertical frame member being opposite respectively to the corresponding first and second recesses of the second vertical frame member;

(b) an exterior gasket composed of a pair of male and female halves having interfitting edges, each of said male and female gasket halves having a base fitted in said second recess of a respective one of the first and second vertical frame members;

(c) an interior gasket having opposite edge portions fitted in the opposite first recesses of said interior parts of the first and second vertical frame members, each of the opposite edge portions of said interior gasket projecting beyond said interfitting edges of said male and female gasket halves in an edgewise direction of the curtain wall units;

(d) said male gasket half having along said edge thereof a longitudinal tongue, and said female gasket half having along said edge thereof a longitudinal groove receiving said tongue, one of the opposite edge portions of said interior gasket projecting beyond a distal edge of said tongue of said male gasket half; and (e) the extent to which each said edge portion of said interior gasket projects beyond said interfitting edges of said male and female gasket halves being smaller than half the length of said interior gasket and larger than the length of each said edge portion.

2. A joint assembly according to claim 1, each of the first and second vertical frame members being composed of a pair of interior and exterior parts, said first and second recesses being disposed in said interior and exterior parts respectively.

* * * * *